US005449172A

United States Patent [19]

Hansen

[11] Patent Number: 5,449,172

[45] Date of Patent: Sep. 12, 1995

[54] PINBALL PROPERTY CHANGING TARGET

[75] Inventor: Bryan P. Hansen, Des Plaines, Ill.

[73] Assignee: Gamestar, Inc., Arlington Hts., Ill.

[21] Appl. No.: 255,385

[22] Filed: Jun. 8, 1994

[51] Int. Cl.[6] ..... A63F 7/36

[52] U.S. Cl. ..... 273/127 R; 273/118 R; 273/118 A; 273/121 R; 273/121 A

[58] Field of Search ..... 273/118, 119, 121, 127 R, 273/127 B

[56] References Cited

U.S. PATENT DOCUMENTS

| | | | |
|---|---|---|---|
| 4,353,553 | 10/1982 | Krynski | 273/121 R |
| 4,354,681 | 10/1982 | Garbark | 273/121 R |
| 4,773,646 | 9/1988 | Joos, Jr. et al. | 273/121 A |
| 4,934,699 | 6/1990 | Kaminkow et al. | 273/121 A |
| 5,226,653 | 7/1993 | Bil et al. | 273/121 A |
| 5,330,182 | 7/1994 | Kaminkow | 273/121 A X |

*Primary Examiner*—Raleigh W. Chiu

*Attorney, Agent, or Firm*—Robert E. Browne; Gary R. Jarosik

[57] ABSTRACT

A target for a pinball game utilizing a pinball rolling on a game surface is provided. The target includes a single pallet having disposed thereon a first display and a second display. A mask is disposed in overlapping relation with the single pallet. A pinball activatable switch is used for generating a detection signal. A solenoid is used for changing the overlapping relation between the mask and the single pallet in response to the detection signal between a first relationship wherein only the first display is visible and a second relationship wherein only the second display is visible.

11 Claims, 3 Drawing Sheets

PINBALL PROPERTY CHANGING TARGET

FIELD OF THE INVENTION

This invention relates to a pinball machine target, and more particularly relates to such a target in which a light reflective display is visible in at least two different states.

DESCRIPTION OF THE PRIOR ART

As far as the applicant is aware, a pinball light reflective target of the type described in this specification is a new innovation. Although pinball games have used colored lights to change the color of a target, the applicant is unaware of any light reflective target that changes its visibility state in response to movement of a pinball.

SUMMARY OF THE INVENTION

There is a need in pinball games to create the illusion that a target has radically changed its form instantaneously in response to successfully aiming a pinball at the target. By employing the unique target described in the specification, a pinball player is given the illusion that the target has rapidly and mysteriously changed its form without the use of light-emitting filaments. Such a target adds to the enjoyment of the game and gives a player incentive to strike the target as often as possible in order to watch it change from one form to another.

Accordingly, it is an object of the present invention to provide an improved pinball target which can change from one visibility state to another in response to movement of the pinball without employing light emitting devices.

Another object of the present invention is to provide a target of the foregoing type which uses only light reflective elements.

Still another object of the present invention is to provide a target of the foregoing type in which a pinball player receives the illusion that a target instantaneously changes form in response to successful aiming of the pinball.

The invention is useful for a target for pinball games utilizing a pinball rolling on a game surface. In such an environment, a preferred form of pinball target made in accordance with the invention includes first and second light reflective displays. The displays may differ in color and pattern. A support means is used to carry the first and second light reflective displays, preferably on a single pallet. A mask enables the visibility of the first and second light reflective displays to be altered from a first state to a second state. A detection means, such as a switch, generates a detection signal in response to successful aiming of the pinball by an operator toward the target. The support means is moved relative to the mask in response to the detection signal so that the first state of visibility is changed to the second state of visibility. For example, the pattern or color of the display may change simultaneously or separately in a rapid manner which gives the operator the illusion that the target has changed form instantaneously.

BRIEF DESCRIPTION OF THE DRAWINGS

These and other objects, advantages and features of the invention will appear for purposes of illustration, but not of limitation, in connection with FIGS. 1–7 wherein like numbers refer to like parts throughout and in which.

DETAILED DESCRIPTION OF THE PREFERRED EMBODIMENT

Figure 1:
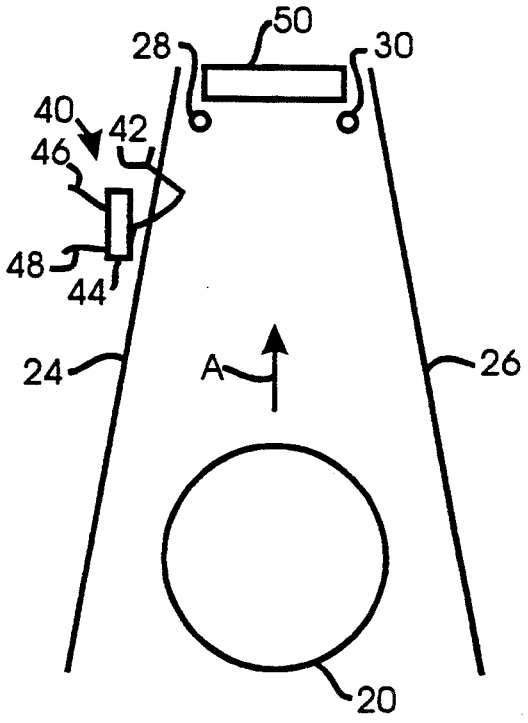
FIG. 1 is a top plan schematic view of a preferred form of target made in accordance with the invention shown in connection with a pinball game in which a pinball is approaching the target and an adjacent switch.
Figure 3:
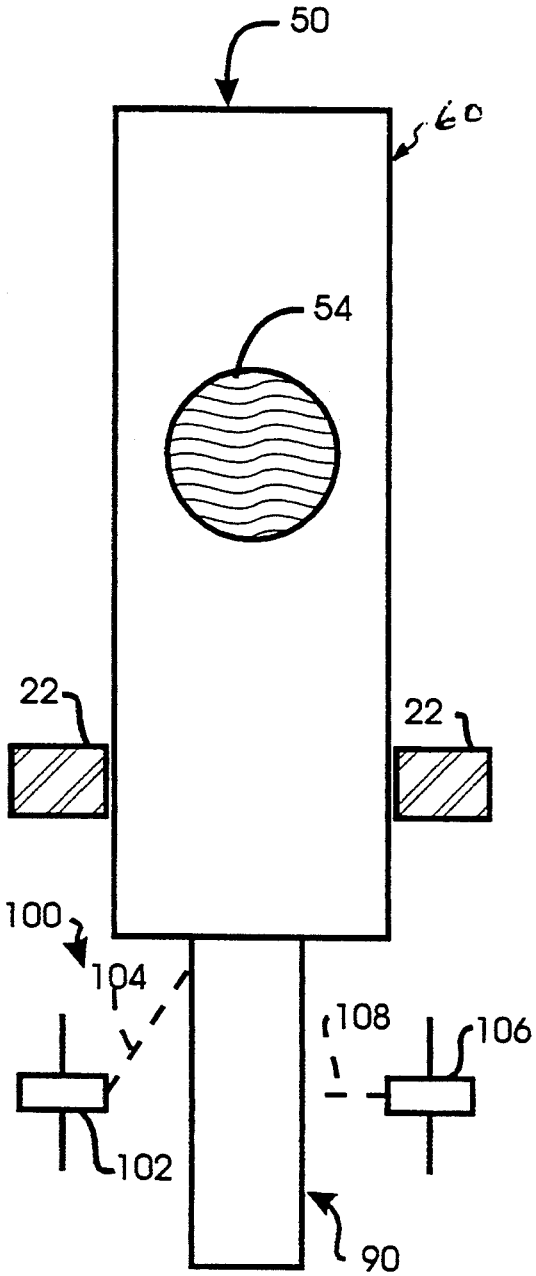
FIG. 3 is an enlarged, front elevational view of the target shown in FIG. 1 during a first state of visibility.

Referring to FIG. 1, the preferred embodiment is preferably used with a pinball game employing a pinball 20 rolling on a pinball game playing surface 22 (FIG. 3). The game employs guides 24 and 26 which are attached to surface 22 in order to guide pinball 20 toward target 50.

Bumpers 28 and 30 are placed in front of target 50 to prevent pinball 20 from actually making contact with the target in order to avoid possible damage to the target.

A conventional switch 40 is mounted adjacent guide 24. The switch includes a rotatable arm 42 that is movable relative to a conventional switch box 44 that is capable of generating a detection signal on conductors 46 and 48 in response to rotation of arm 42 by pinball 20.

Figure 4:
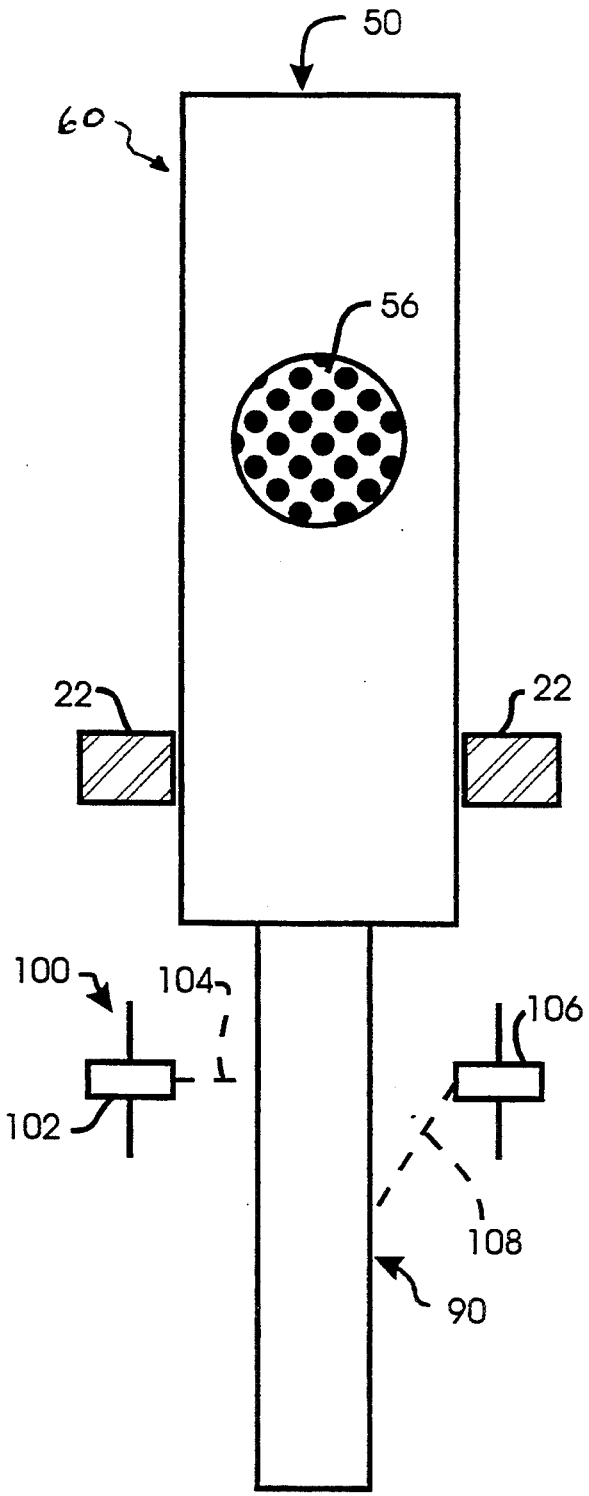
FIG. 4 is an enlarged, front elevational view of the target shown in FIG. 3 during a second state of visibility.

Referring to FIGS. 3 and 4, target 50 basically comprises a light reflective surface 54 having a blue wave pattern and a light reflective surface 56 having a red polka dot pattern. Target 50 also includes a mask 60, a support assembly 90 and a movement assembly 100 that are interconnected as shown.

Figure 5:
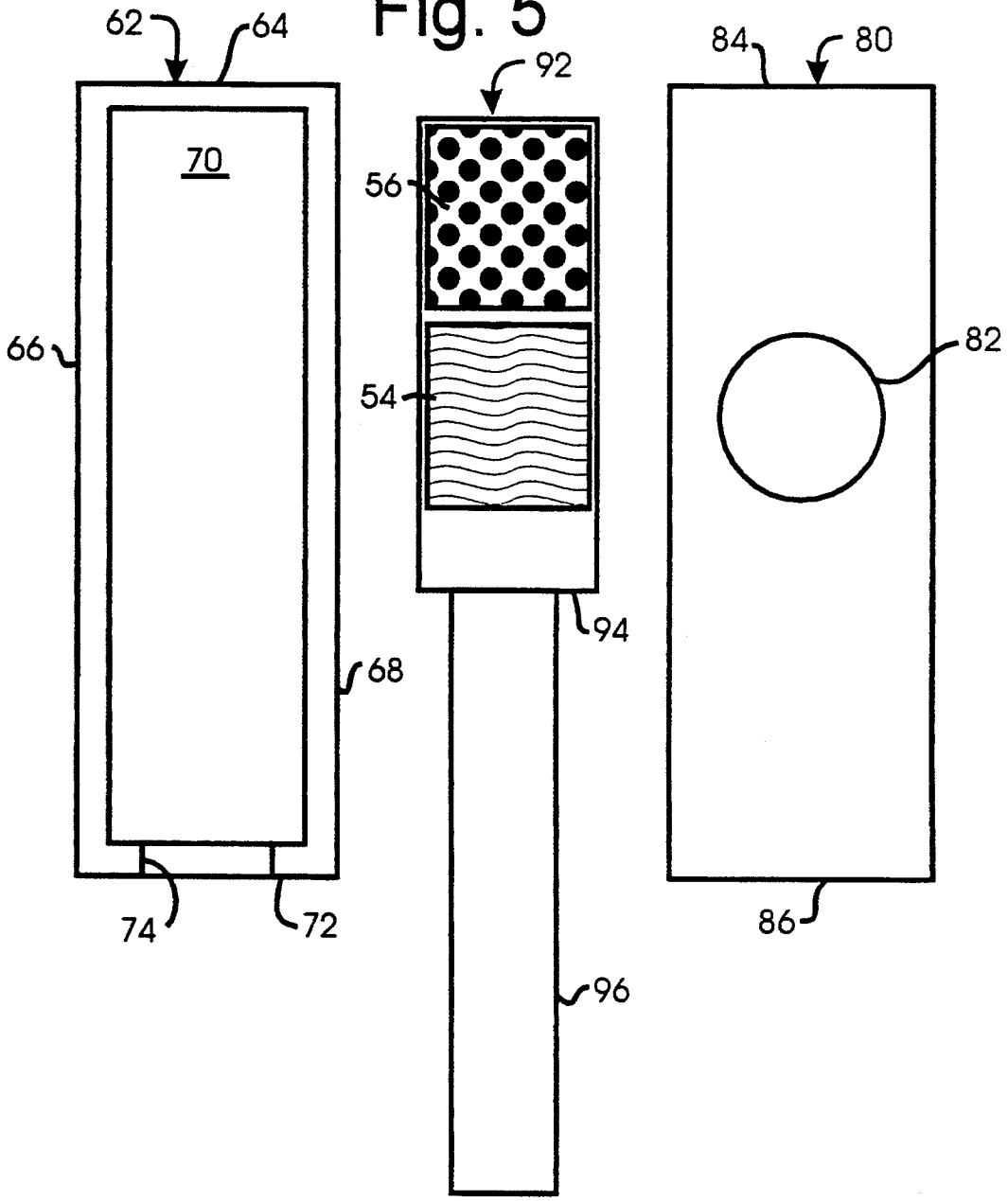
FIG. 5 is a front plan view of the target shown in FIG. 3 disassembled to illustrate the various components in more detail.
Figure 6:
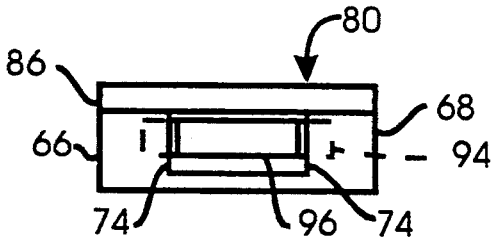
FIG. 6 is a bottom plan view of the target shown in FIG. 3.
Figure 7:
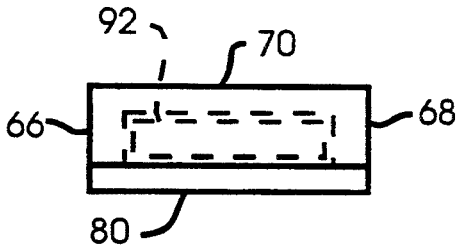
FIG. 7 is a top plan view of the target shown in FIG. 3.

Referring to FIGS. 5–7, mask 60 comprises an enclosure box 62 having a top 64, sides 66 and 68, a back 70 and a bottom 72 that is fitted with a slot 74.

Mask 60 also includes a cover panel 80 having an circular opening 82, a top edge 84 and a bottom edge 86.

Referring to FIG. 5, support assembly 90 includes a pallet 92 having a panel 94 that carries light reflective surfaces 54 and 56 as shown and a depending arm 96 that fits through slot 74 of enclosure box 62. Surfaces 54 and 56 may be applied to panel 94 by any convenient means, such as decals or paint. Panel 94 and arm 96 are solidly joined together or are unitary. Pallet 92 is constructed to move vertically within box 62 so that either surface 54 or surface 56 shows through opening 82 in panel 80.

Referring to FIGS. 3 and 4, movement assembly 100 comprises a solenoid 102 that is capable of moving pallet 92 in an upward direction by means of a conventional mechanical coupling 104. Movement assembly 100 also includes a solenoid 106 that is capable of moving pallet 92 in a downward direction through a conventional mechanical coupling 108. As shown in FIGS. 3 and 4, target 50 is received through an opening in pinball surface 22 so that the solenoids and pallet arm 96 are hidden from view below surface 22.

FIG. 1 shows pinball 20 moving in the direction of arrow A. The pinball is constrained from lateral movement by guides 24 and 26. When pinball 20 is in the position shown in FIG. 1, target 50 has wave pattern 54 showing through opening 80 as illustrated in FIG. 3.

Figure 2:
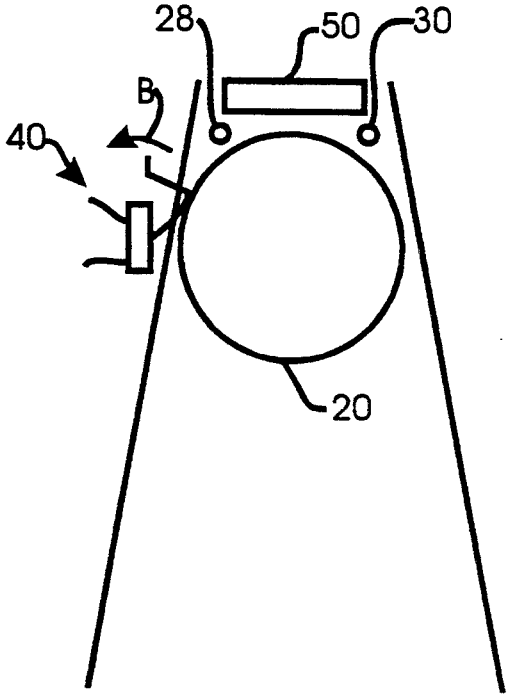
FIG. 2 is a top plan schematic view of the apparatus shown in FIG. 1 as the pinball is actuating the switch.

Referring to FIG. 2, when pinball 20 is close enough to target 50 in order to rotate arm 42 in the direction of arrow B, switch 40 generates a detection signal that is received by a microprocessor (not shown). The microprocessor energizes solenoid 106 and results in mechanical coupling 108 moving arm 96 and pallet 92 in a downward direction so that red polka dot pattern 56 shows through opening 80 as illustrated in FIG. 4.

In response to generation of another detection signal by switch 40, the microprocessor energizes solenoid 102 and results in mechanical coupling 104 moving arm 96 and pallet 92 in an upward direction so that blue wave pattern 54 again shows through opening 80, as illustrated in FIG. 3. Alternatively, the microprocessor may energize solenoids 102 and 106 in response to an event other than generation of a detection signal by switch 40.

Those skilled in the art will recognize that the preferred embodiment may be altered and amended without departing from the true spirit and scope of the invention as defined in the accompanying claims.

I claim:

1. A target for a pinball game utilizing a pinball rolling on a game surface, comprising:

a single pallet having disposed thereon a first light reflective display and a second light reflective display;

a mask disposed in overlapping relation with said single pallet;

detection means for generating a detection signal in response to said pinball; and means for changing said overlapping relation between said mask and said single pallet in response to said detection signal between a first relationship wherein only said first light reflective display is visible and a second relationship wherein only said second light reflective display is visible.

2. Apparatus, as claimed in claim 1, wherein said first light reflective display has a first color and said second light reflective display has a second color different from said first color.

3. Apparatus, as claimed in claim 1, wherein said first light reflective display has a first pattern and said second light reflective display has a second pattern different from said first pattern.

4. Apparatus, as claimed in claim 1, wherein said mask comprises an enclosure for said pallet.

5. Apparatus, as claimed in claim 1, wherein said enclosure comprises an opening through which said first or second light reflective display is visible.

6. Apparatus, as claimed in claim 1, wherein said detection means comprises a switch having an arm movable in response to contact of said pinball.

7. Apparatus, as claimed in claim 1, wherein said means for changing comprises solenoid means for positioning said pallet in said first relationship and for positioning said pallet in said second relationship.

8. Apparatus, as claimed in claim 7, wherein said solenoid means is mechanically coupled with said pallet.

9. Apparatus, as claimed in claim 1, and further comprising a bumper that prevents contact of said pinball with said target.

10. A pinball machine, comprising:

a game surface;

a rolling ball movable over said game surface;

a single pallet extending above said game surface having disposed thereon a first display and a second display;

a mask disposed in overlapping relation with said single pallet;

a solenoid linked to one of said single pallet or said mask and responsive to an electrical signal for changing said overlapping relation between said mask and said single pallet between a first relationship wherein only said first display is visible and a second relationship wherein only said second display is visible.

11. A pinball machine, comprising:

a game surface;

a rolling ball movable over said game surface;

a single pallet movably extending above said game surface having disposed thereon a first display and a second display;

a mask having a hole therethrough disposed in fixed overlapping relation with said single pallet;

a switch disposed on said game surface for generating a detection signal in response to said pinball; and a solenoid linked to said single pallet and responsive to said detection signal for moving said single pallet between a first position wherein said first display is visible through said hole and a second position wherein said second display is visible through said hole.

* * * * *